US005307886A

United States Patent [19]

Hopper

[11] Patent Number: 5,307,886

[45] Date of Patent: May 3, 1994

[54] METHOD FOR CASING A HOLE DRILLED IN A FORMATION

[76] Inventor: Hans P. Hopper, Hill House, Whiterashes, Aberdeen, AB5 OQL, United Kingdom

[21] Appl. No.: 874,137

[22] Filed: Apr. 27, 1992

[30] Foreign Application Priority Data

May 2, 1991 [GB] United Kingdom ..... 9109543

[51] Int. Cl.[5] ..... E21B 7/28

[52] U.S. Cl. ..... 175/53; 175/57; 175/106; 175/331; 166/289

[58] Field of Search ..... 175/53, 57, 331-334, 175/350, 296, 344; 166/276, 289

[56] References Cited

U.S. PATENT DOCUMENTS

| | | | |
|---|---|---|---|
| 1,375,094 | 4/1921 | Humason | 175/334 |
| 2,187,895 | 1/1940 | Sanders | 166/276 |
| 2,193,808 | 3/1940 | Dieterich | 166/276 |
| 2,241,486 | 5/1941 | Sharp | 175/385 |
| 2,703,698 | 3/1955 | Westerman | 175/334 |
| 3,333,635 | 8/1967 | Crawford | 166/276 |
| 3,387,673 | 6/1968 | Thompson | 175/385 |
| 3,559,736 | 2/1971 | Bomhardieri | 166/276 |
| 3,800,875 | 4/1974 | Hardy et al. | 166/276 |
| 4,117,897 | 10/1978 | Lloyd | 175/106 |
| 4,706,765 | 11/1987 | Lee et al. | 175/334 |

FOREIGN PATENT DOCUMENTS

| | | |
|---|---|---|
| 853376 | 11/1960 | United Kingdom . |
| 966286 | 8/1964 | United Kingdom . |
| 2224056A | 4/1990 | United Kingdom . |

*Primary Examiner*—Ramon S. Britts
*Assistant Examiner*—Frank S. Tsay
*Attorney, Agent, or Firm*—Nixon & Vanderhye

[57] ABSTRACT

Method for casing a hole drilled in a formation having an enlarged section located below a previously cased section. The method includes running casing into the enlarged section wherein the casing is of slightly smaller diameter than that present in the previously cased section, pumping cement into the annulus formed between the outer surface of the casing and the enlarged section of the formation, providing a valve arrangement in the casing to permit circulation of the cement between the annulus and an inner portion of the casing, securing the casing in position within the hole and hanging and packing off in the last casing string. Finally, the previously cased string is latched and sealed to the last casing string.

9 Claims, 6 Drawing Sheets

METHOD FOR CASING A HOLE DRILLED IN A FORMATION

The present invention relates to a drilling assembly in particular to a drilling assembly having a percussion operation.

BACKGROUND OF THE INVENTION

In the drilling of wells for the exploration of oil or gas two main types of drill bit are used, roller cone bits and polycrystalline diamond compact (PDC) bits.

The roller cone drill bit is based on three toothed cones being rotated under compression causing the teeth to crush and scoop the rock as they rotate. This method of drilling however is limited by the weight which the cone bearing can tolerate, the life of the cones and the speed of rotation which is typically limited to a maximum of 90 rpm.

The PDC bit achieves the cut by shearing off the top surface of the rock by means of a scraping action. This type of bit depends on high speed rotation but requires a limited weight to prevent stalling.

Other types of drilling methods have been used for example impact drilling and cable drilling where a hammer bit is vertically impounded into the bottom of the hole.

Another type of drilling system is disclosed in U.S. Pat. No. 4,289,210 comprising a plurality of chisel blades which are impacted periodically downwards into the formation being drilled.

All these types of drilling systems may be used for the conventional method of drilling and casing a well.

It is normal practice when drilling into a formation that the initial hole drilled is of a much greater diameter than the final working hole required for the subsequent production of hydrocarbons from the formation.

The parameters that control the size of the first hole are:

(a) the size of the reservoir casing (b) the casing strings required to achieve safe drilling practices, and (c) the annular sizes required between the casing and open hole to allow satisfactory cementation.

It can be seen that the starting size of the hole is a straight addition of these factors whereby the largest open hole bit that is run has to fit inside the last casing string.

DESCRIPTION OF THE INVENTION

We have now found that by using a drilling assembly comprising a retractable drilling unit imparting a percussion action it is possible to cut a hole which is of greater diameter than the casing through which the drilling assembly has been run.

Thus according to the present invention there is provided a drilling assembly comprising:

(i) a vertically extending rotatable member, (ii) means for drilling a hole fixed to the lower end of said member, and (iii) a hole enlarging drilling unit located above said drilling means having a number of chisel blades circumferentially angularly offset and retractably mounted on said member, said drilling unit being provided with means for imparting a percussion drilling motion to said chisel blades.

The means for drilling a hole may comprise a conventional drill bit, for example a roller cone bit or a polycrystalline diamond (PDC) bit.

More preferably the means for drilling the hole comprises a drilling unit having a number of chisel blades vertically arranged with said member whereby the unit is provided with means for imparting a percussion drilling motion to said chisel blades.

If required further similar drilling units comprising chisel blades may be provided circumferentially arranged around said member. Such chisel blades may be angularly offset from the rotatable member.

The means for drilling the hole may be suitably provided with a steering unit and a sensing unit to enable accurate drilling to be performed.

Electrical signals and power may be supplied to the drilling assembly by means of a cable assembly as disclosed in GB 2203602-A. This may be provided by means of a central conduit or by some other suitable arrangement.

The chisel blades located in the drilling assembly according to the present invention impart a percussion action and may be activated by means of rotating load plates within each drilling unit. The load plates are sealed and supported on heavy duty bearings which allow high loads to be imparted to the chisel blades.

By using this arrangement of load plates high rotational speeds may be achieved, for example 2000 rpm.

The ability to remove consolidated rock while drilling depends on the cutting frequency and force used. The drilling assembly of the present invention improves both functions resulting in an increased efficiency of drilling.

By using this arrangement the chisel blades located in the hole enlarging drilling unit may be mounted angularly to enable the drilling assembly to cut a larger hole than the assembly itself.

Each chisel blade is mounted on a chisel shaft located within a sealed body. A drive plate is located within the sealed body and is keyed to the central high speed rotating shaft. The rotating drive plate induces a vertical motion in a non-rotational quash plate which imparts a vertical action to the chisel blades by means of a knuckle joint.

Each chisel blade is spring loaded and may in the event of failure be easily replaced on the end of the chisel shaft.

Upward movement of the structural rotational central shaft will cause the chisel blades to withdraw in a retract stroke.

The following description illustrates a drilling assembly according to the present invention wherein the means for drilling the hole comprises a pilot drilling bit and a prime drilling unit each comprising a number of chisel blades.

The pilot bit is designed to cut the initial hole through which the remainder of the assembly will follow. Steering and sensing units may be suitably located immediately above the pilot bit to enable the pilot bit to be biased in a predetermined direction.

In order to achieve this a slightly larger hole may be cut than is required to enable the remainder of the assembly to be steered eccentric to the centreline of the previous section of drilled hole.

If required the drilling assembly may be adapted to drill a core. In this situation the chisel blades would be designed to leave the rock in the centre of the hole in place. The hollow main section would then be used to collect the core in a liner sleeve isolated from the circulating mud.

The pilot bit is provided with a centrally positioned jet nozzle to allow mud to be jetted directly in between the chisel blades. In this arrangement the jet nozzle would be placed close to the rock formation.

In a preferred configuration the pilot bit is provided with six chisel blades.

Each blade is located in relation to each other at a different height whereby during operation the rotating drive plate will act on the quash plate resulting in only one blade cutting at a time.

The prime drilling unit is used to follow the pilot drilling unit and to remove the bulk of rock to achieve a hole.

The arrangement is similar to that in the pilot bit except a number of rows of chisel blades operated by means of the respective number of drive plates may be used.

In a preferred embodiment two rows of chisel blades may be used operated by two tiers of drive plates.

If required the outer chisel blades may be placed slightly angularly offset in relation to the chisel blades nearest the central rotating member.

A number of mud injection nozzles to wash the cutting face are in communication with the main mud flow by means of a flow port.

The hole enlarging drilling unit is positioned above the prime drilling unit. Both the pilot bit and the prime drilling unit achieve hole sizes equivalent to their diameters. In order to obtain the larger hole diameter suitable for a subsequent cement circulation path the drill must be able to cut a larger hole.

The hole enlarging drilling unit comprises chisel blades which may be angularly offset from the drill string and housed in rotating bodies to enable each chisel to retract within the central member. This enables the chisel blades to cut and still be able to be run and retrieved through the last casing.

Rotation of the chisel body in a clockwise direction is achieved by use of a downward weight resulting in the chisel blades protruding outwards. Upward life on the central member will cause the chisel bodies to rotate anti-clockwise and be retracted within the central member.

In the event of any malfunction of the system the rotation effect may be achieved by clockwise rotation of the drill string.

Above the drilling assembly of the present invention is provided a hole reamer used to improve the hole wall face for weight inducer slips located higher up the drill string. The hole reamer also removes any jagged edges left behind by the chisel blades.

A gear box is provided to establish a rotational ratio between the high speed rotation required for the drilling assembly and the slower speed required for the hole reamer.

The rotational power is supplied by a suitably positioned motor or motors.

Above the drilling assembly, hole reamer and motor are a set of drillstring weight inducers comprising a set of hydraulically activated and cylinder driven set of slips which may be powered by the internal hydraulic mud pressure. The weight inducer operation may be controlled, monitored and operated electrically to ensure the correct sequencing.

Each weight inducer will supply sufficient downward force for the drilling operation. The slips are engaged on the walls of the bore hole to provide the necessary grip to supply the downward force.

The preferred number of weight inducers is three whereby two inducers are required to share the required load while the third is undergoing recycling.

Alternatively the motor and gearbox may be positioned above the weight inducers.

To allow the drill string to rotate without damaging the lastcasing and causing key-seats, casing drillpipe bearings may be installed.

Above the series of weight inducers there is provided a drill pipe blow out preventor with choke control to enable the cased hole to be shut off and also to control the flow of fluid from below the drilling assembly into the cased section of the well.

In the event of a gas or oil kick the blow out preventor will enable the lower section of the well to be shut off.

A kick-circulating diverting sub may be provided above the blow out preventor. This may be used to shut-off the drill pipe to prevent mud being pumped down to the drilling assembly and to vent the drillpipe mud into the casing. With the blowout preventor isolating the open hole and the kick-circulating diverting sub shutting off the drill pipe a low pressure kick control programme may be followed eliminating the risk of new hydrocarbon influxes.

The drilling assembly of the present invention may be used to produce a drilled hole which has a greater diameter than that of the casing through which the drilling assembly has been run. This allows a casing sequence to be run which does not require the open hole/casing volume which in conventional casing systems is required for satisfactory cementation to both support the casing and to isolate the respective formations.

The cement circulation path in a conventional casing sequence flows down the casing, round the casing shoe and up the annulus between the casing and the open hole. This requires an adequate open hole/casing volume for each section of casing run and typically to achieve a 7" linear through the pay zone an initial 36" bit is required.

By enlarging the drilled hole by means of the drilling assembly of the present invention an adequate open hole/casing volume for cementation is provided for each section of casing subsequently run into the open hole. By providing means whereby the circulation path can pass back up the inside of the casing, rather than continue up the annulus formed between the casing and the formation, only a small space is required between successive casing sections.

Suitable means for allowing the flow to pass up the inside of the casing may be provided by a differential valve (DV) which is run in the casing string whereby its final position is just below the last casing shoe.

This arrangement allows the circulation path to flow down the casing, round the casing shoe, up the annulus between the casing and the open hole, through the open DV and then back up the inside of the casing.

The differential valve may be operated by suitable means for example by means of the casing running tool.

This sequence has the advantage of requiring smaller differences in diameter between successive casing sections and therefore smaller diameter holes may be drilled. For example to achieve a 7" linear through the pay zone an initial bit of only approximately 17½" may be required.

The drilling assembly of the present invention also has the advantage of allowing drilling to be performed with more weight on the bit and at higher speeds enabling drilling to be carried out more quickly.

Thus there is provided a method for casing a hole drilled in a formation, said hole having been drilled by means of the aforementioned drilling assembly and having an enlarged section located below a previously cased section said method comprising:

(i) running casing into said enlarged section wherein said casing is of slightly smaller diameter than that present in the previously cased section, (ii) pumping cement into the annulus formed between the outer surface of said casing and the enlarged section of said formation, (iii) providing means in said casing to permit a circulation path for said cement between said annulus and an inner portion of said casing, (iv) securing said casing in position within said hole, (v) hanging and packing off in the last casing string, and (vi) latching and sealing the previously cased section to said last casing string.

The means for permitting the circulation path in the casing may suitably be by use of a differential valve.

The latching and sealing operations may be performed by use of suitable tools.

BRIEF DESCRIPTION OF THE DRAWINGS

The present invention is further illustrated with reference to the accompanying drawings, in which.

DESCRIPTION OF PREFERRED EMBODIMENTS

Figure 1:
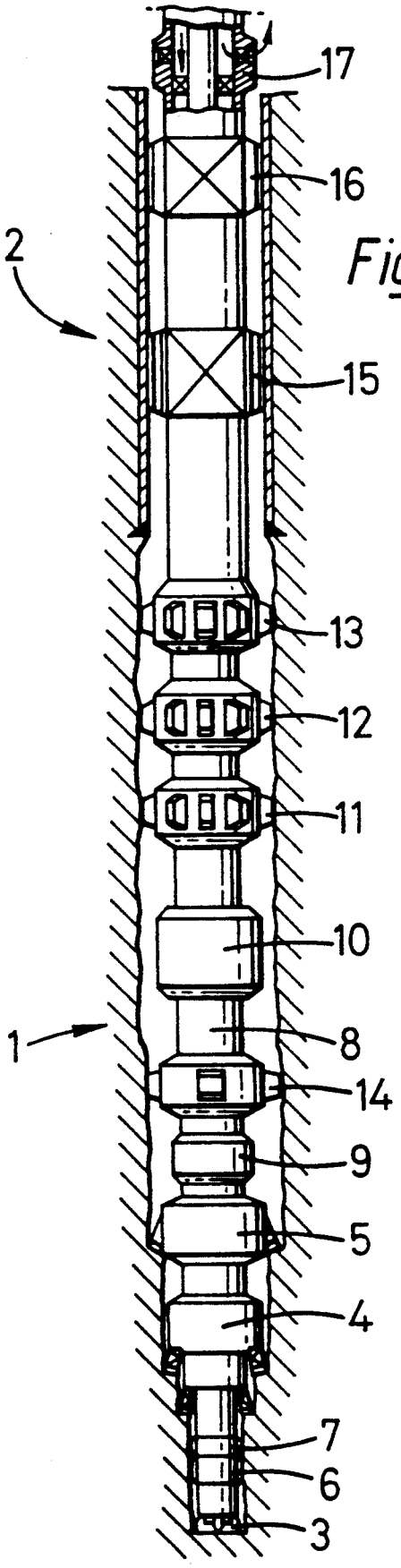
FIG. 1 is a schematic view of a drilling assembly according to the present invention located on a drill string disposed within a partially cased well bore.

In FIG. 1 the drilling assembly is shown located within a drill string disposed between an open hole section (1) and a cased hole section (2). The drilling assembly comprises in sequence a pilot bit (3), a prime drilling bit (4) and a hole enlarging bit (5). Arranged above the pilot bit are a sensing unit (6) and a steering unit (7). These are located in sequence between the pilot bit and the prime drilling unit. The drilling assembly is arranged at the lower end of a rotatable member (8) which contains a gear box (9) and torque motor (10). Weight inducers with retractable slips are shown at (11), (12) and (13), and a reamer with retractable blades at (14). The upper portion of the drill string is provided with a casing drill pipe bearing (15), a drill pipe blow out preventor with choke control (16) and a kick circulating diverting sub (17).

Figure 2:
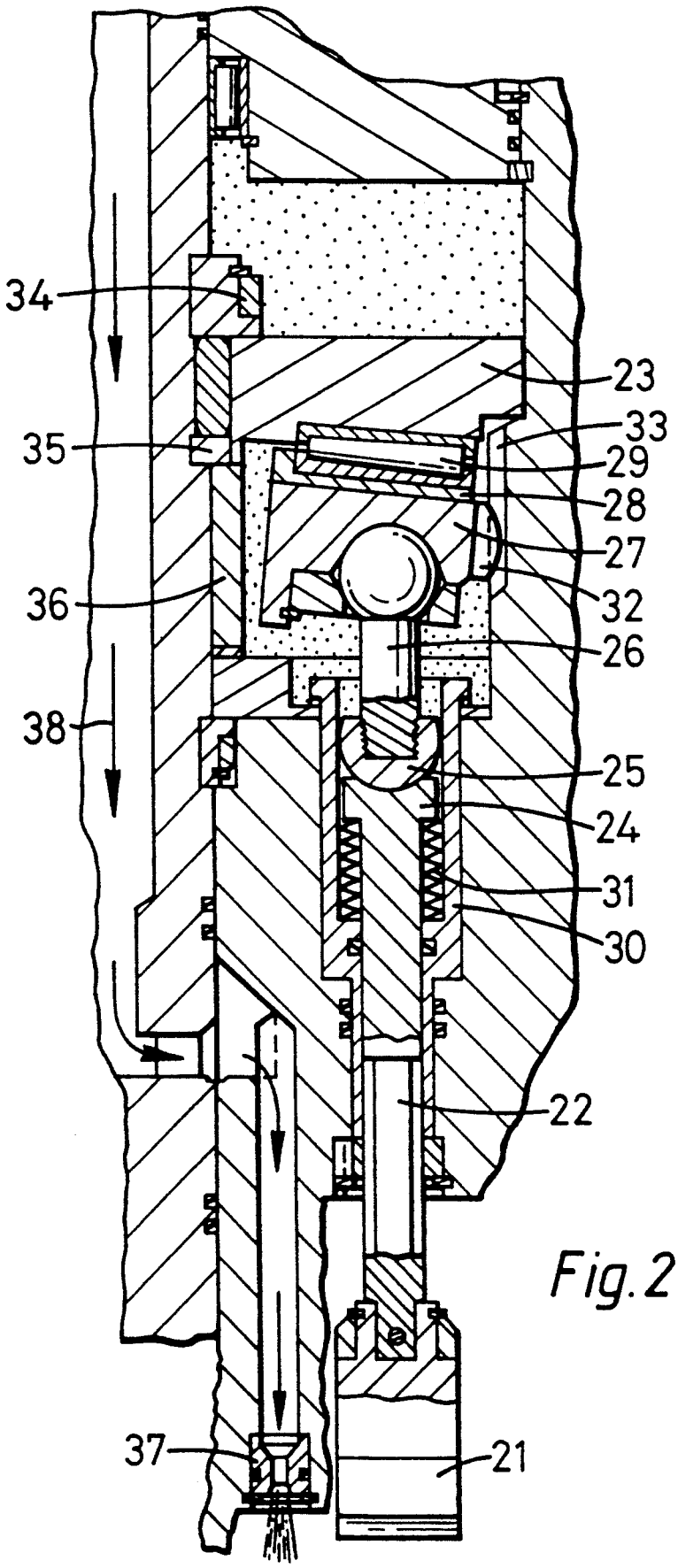
FIG. 2 is a general schematic view of a chisel blade unit as used in the drilling assembly of the present invention.

FIG. 2 represents a chisel blade which may be used in the drilling assembly of the present invention. A chisel blade (21) located on a jack rod (22) is driven by a drive plate (23) by means of the anvil head (24) of the jack rod and a hammer head (25). The hammer head is joined by a knuckle (26) to a quash plate (27) positioned below and abutting a slip plate (28). The slip plate locates with the drive plate (23) by means of a tapered heavy duty bearing (29). The jack rod retracts within a retraction sleeve (30) facilitated by a spring (31). An anti-rotation key (32) is provided adjacent to the quash plate (27) together with an anti-rotation slot (33). The unit is also provided with stop rings (34), (35), and a compression sleeve (36). A jet nozzle (37), in communication with the mud flow (38), is positioned in close proximity to the chisel blade (21).

Figure 3:
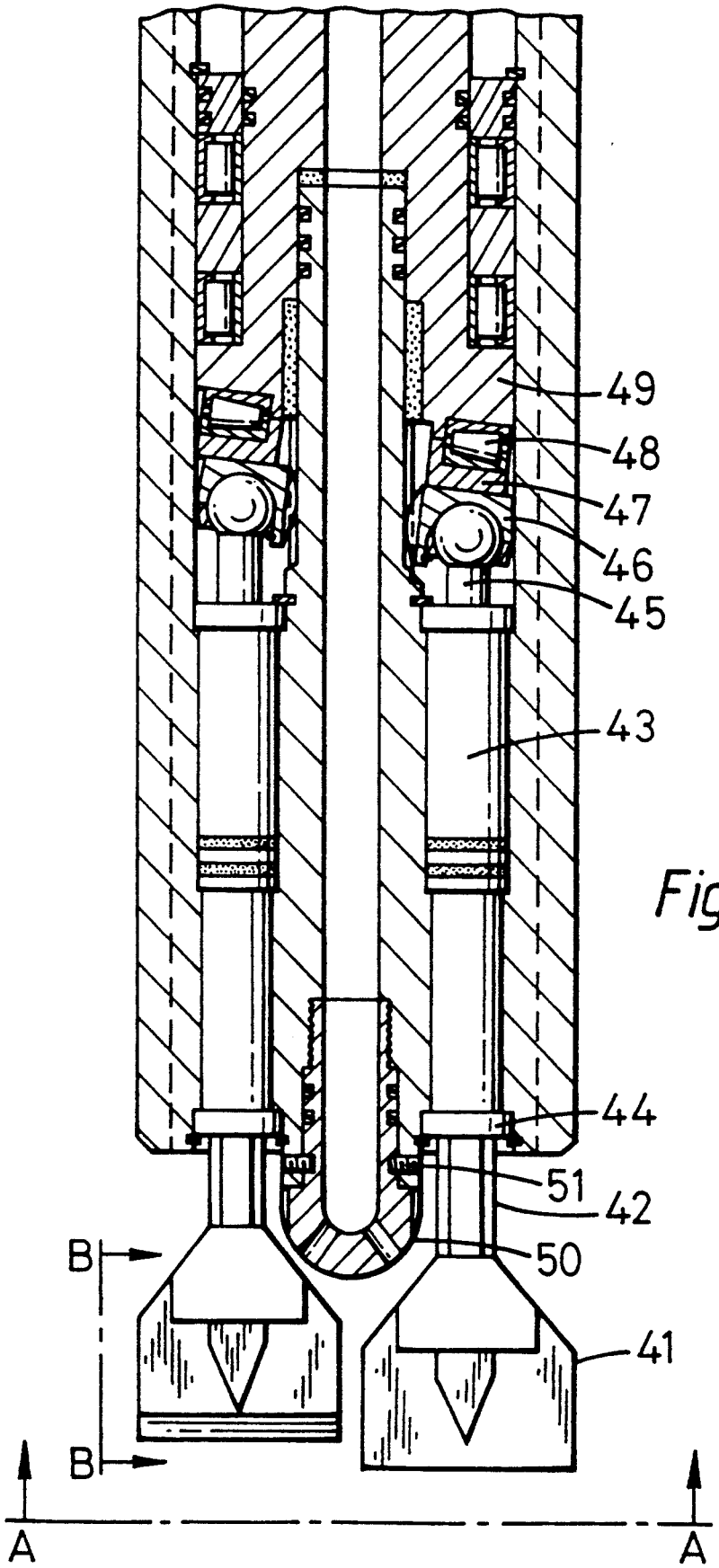
FIG. 3 is a schematic view of the lower part of the drilling assembly showing the pilot bit.

FIG. 3 shows a pilot bit unit with two of six chisel blades (41) as described in FIG. 2 in view. Each blade is attached by means of the jack rod (42) located within the sleeve (43) fitted at its lower end with an antirotation guide (44). The jack rod is attached by means of the knuckle (45) to the quash plate (46) and the slip plate (47). The tapered bearing (48) allows the slip plate (47) to contact with the drive plate (49).

A threaded multi-ported jet nozzle (50) is positioned in proximity to the chisel blades (41) locked in position by means of pins (51).

Figure 4:
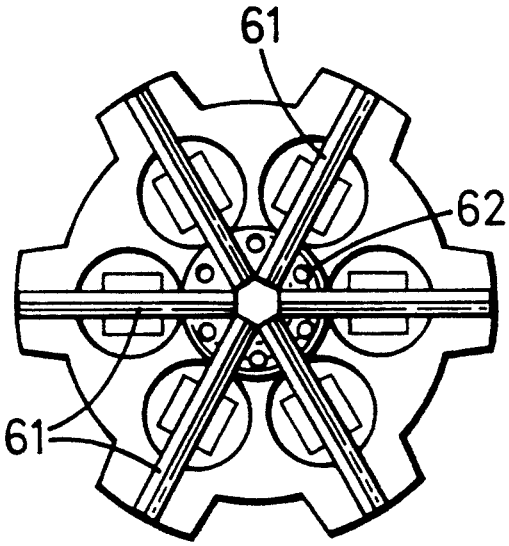
FIG. 4 is a top view of the pilot bit taken along line AA of FIG. 3.

FIG. 4 represents a top view of FIG. 3 showing six chisel blades (61) circumferentially positioned around and below the multi-ported jet nozzle (62).

Figure 5:
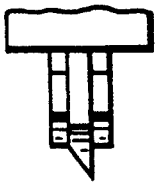
FIG. 5 is a side view of a chisel blade taken along line BB of FIG. 3.

FIG. 5 represents a further view of a chisel bit as shown in FIG. 3.

Figure 6:
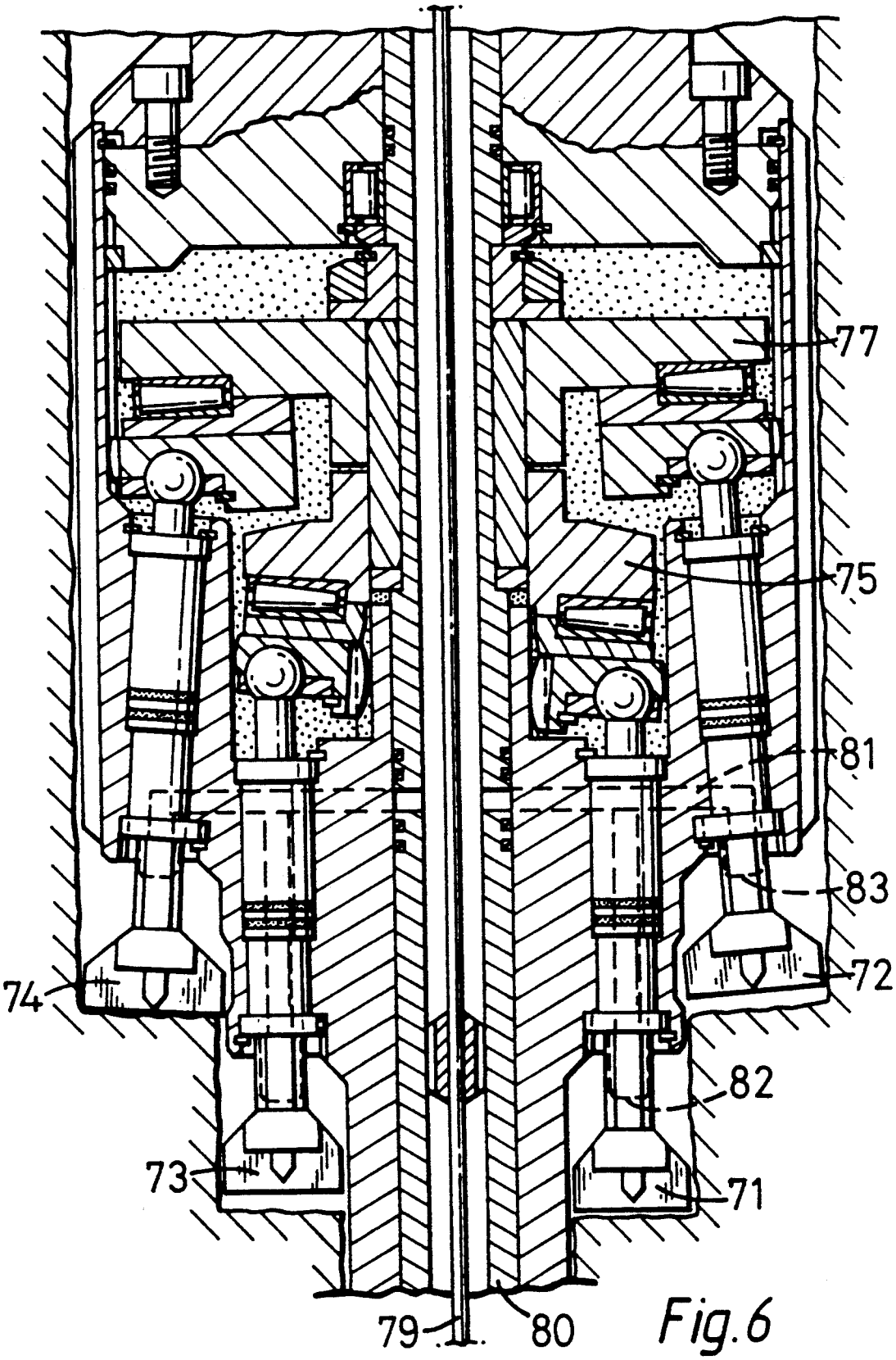
FIG. 6 is a schematic view of the prime drilling unit.

FIG. 6 shows a prime drilling unit with four chisel blades (71), (72), (73) and (74) arranged in a two tier configuration. The respective upper (77) and lower (75) drive plates are shown linked to the chisel blades by a similar arrangement as described in FIG. 2. An electrical conduit (79) is positioned within the central conduit (80) which provides a mud flow to the chisel blades by means of a flow port (81). Each chisel blade has in close proximity a mud injection nozzle, two of which are shown dotted (82, 83).

Figure 7:
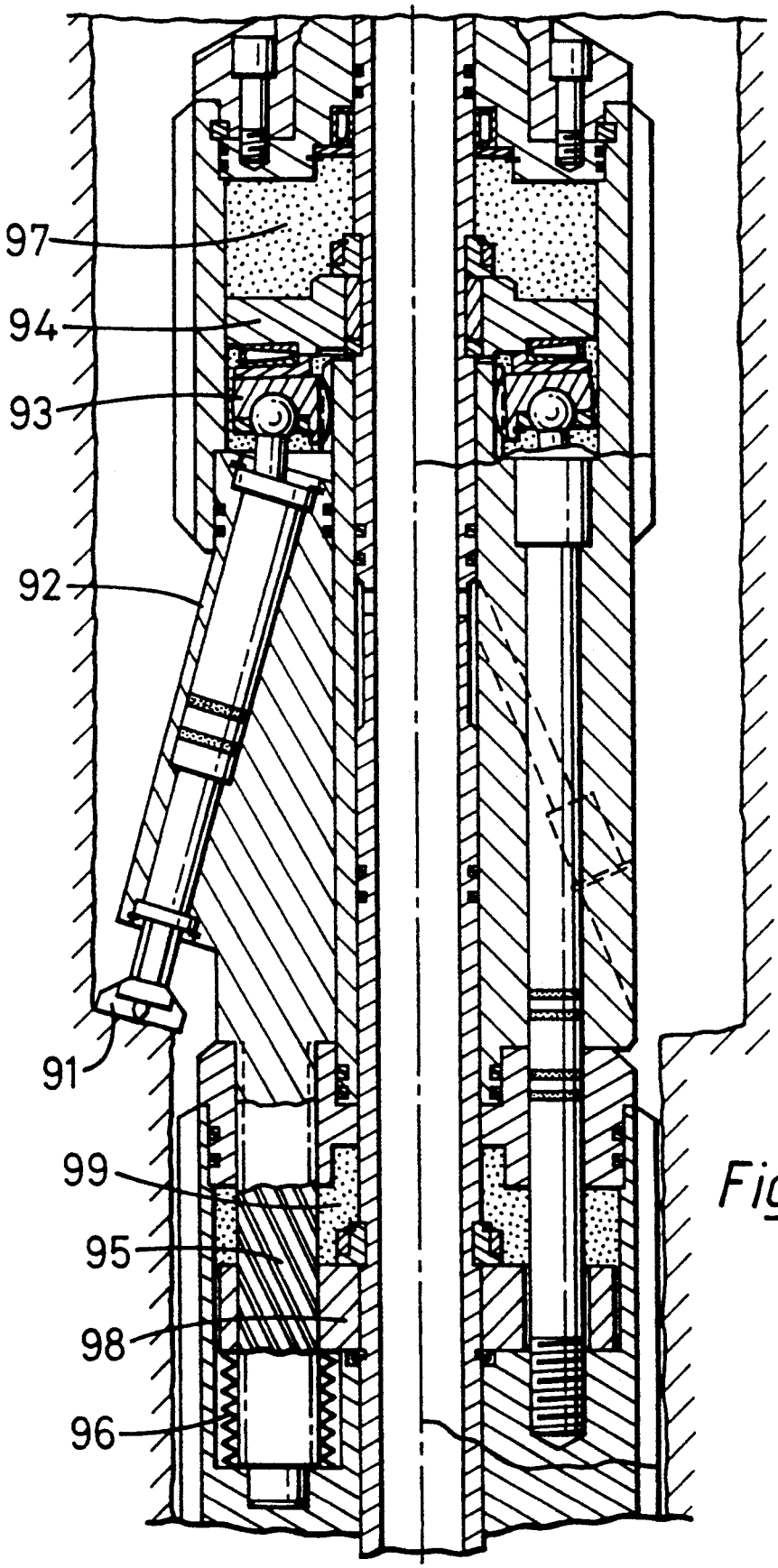
FIG. 7 is a schematic view of the hole enlarging drilling unit.

FIG. 7 shows a hole enlarging drilling unit having a chisel blade (91) connected by means of a rotational pin (92) which is connected as described above to a quash plate (93) and drive plate (94). A pin twist spline (95) is provided with a spring (96) to assist in the rotation of the pin (92). As weight is applied the pin (92) rotates clockwise as the unit is compressed into the main body, the spline (95) rotates and key plate (98) moves downwards causing the pin and chisel blade to create the areas (97,99). Upward pull and clockwise rotation of the drill pipe will allow the chisel blades to rotate anticlockwise into the body reducing the overal diameter for withdrawal through the cased hole.

FIGS. 8(A,B,C) shows a casing sequence which may be used in conjunction with the drilling system of the present invention.

Figure 8A:
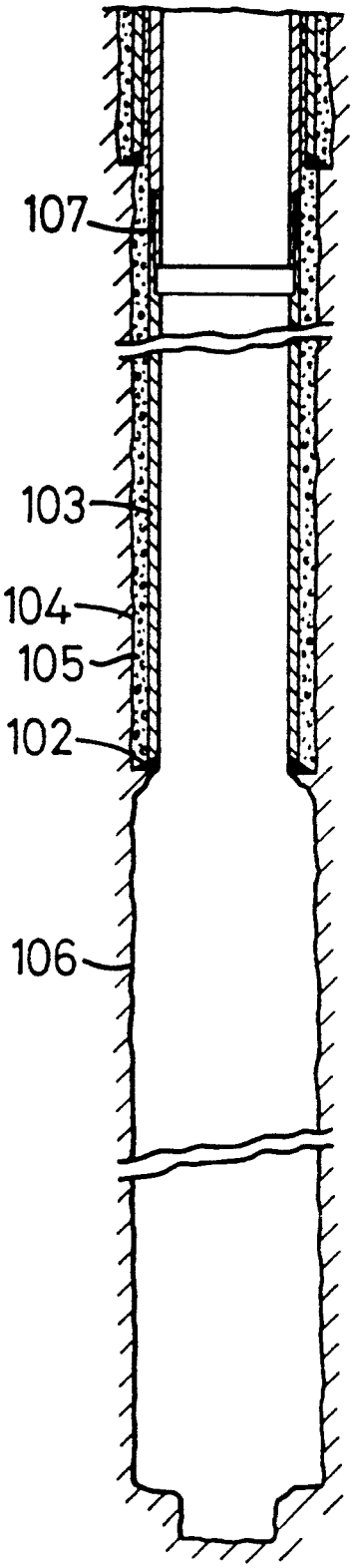
FIGS. 8A, 8B, 8C are schematic views of a casing sequence.

FIG. 8A shows an enlarged hole (106) in which casing (103) terminating in a casing shoe (102) has been run. Cement (105) is positioned between the casing and the formation (104). The casing has a differential valve (107) in the closed position.

Figure 8B:
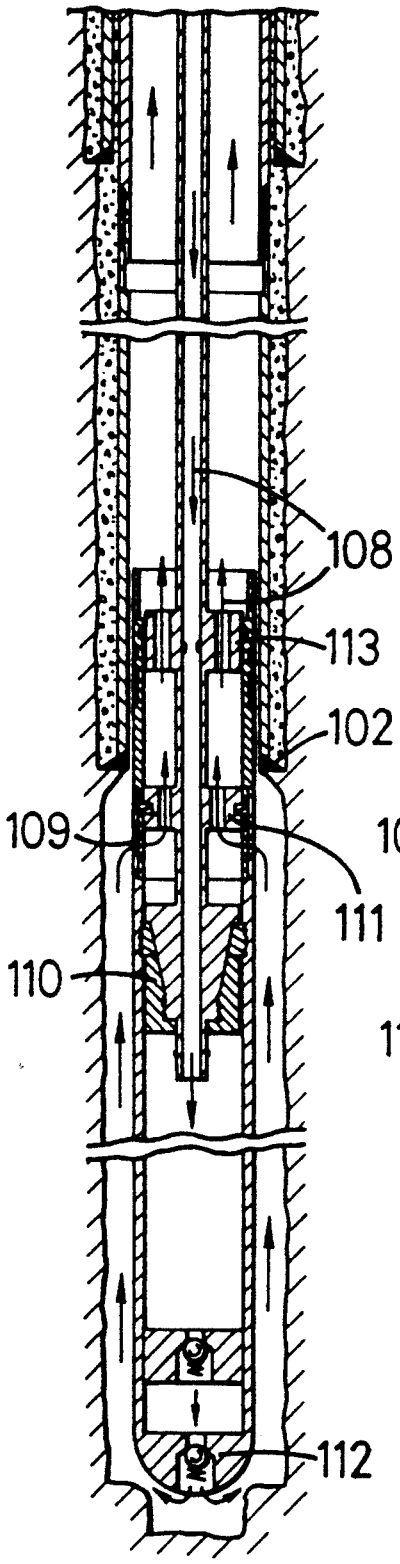

FIG. 8B shows the installation of the next section of casing. A differential valve (109) is positioned just below the last casing shoe (102) and is shown in the open position. The cement flow is shown (108) passing down the central portion of the casing through the casing shoe (112) and up the annulus with the formation. The cement enters the differential valve (109) and then flows back up the inside of the casing. The casing is run by means of a casing running tool (110) which contains a differential valve closing tool (111) and a liner hanger setting tool (113) which sets the hanger and energises the pack-off between the casing.

Figure 8C:
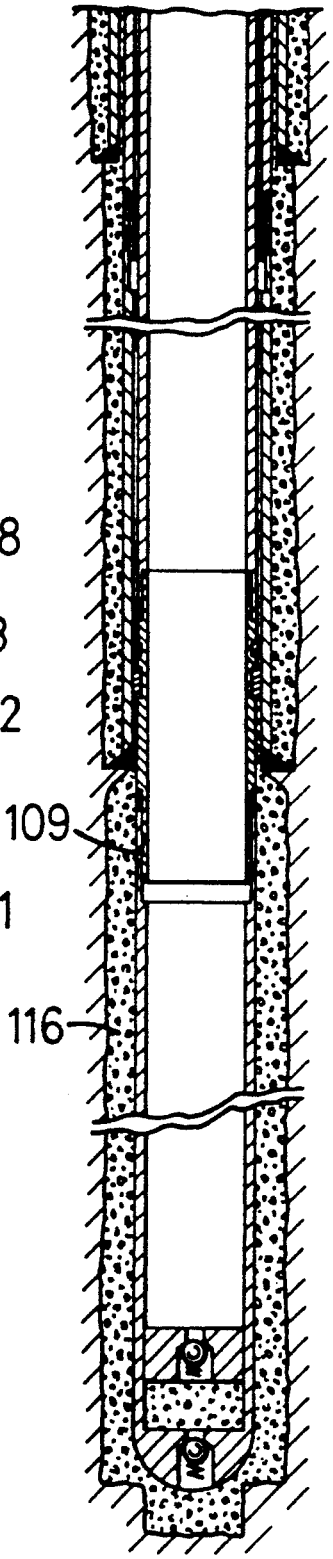

FIG. 8C shows the lower casing in place with the differential valve (109) closed and the cement (116) in place and the upper casing string latched and sealed into the lower casing string.

I claim:

1. A method for casing a hole drilled in a formation, said hole having an enlarged section located below a previously cased section, said method comprising the steps of:

running new casing into said enlarged section, wherein said new casing is of slightly smaller diameter than casing present in the previously cased section;

pumping cement into an annulus formed between an outer surface of said new casing and said enlarged section of said formation;

providing means in said new casing to permit a circulation path for said cement between said annulus and an inner portion of said new casing;

securing said new casing in position within said hole;

hanging and packing off in the last casing string; and latching and sealing the previously cased section to said last casing string.

2. A method according to claim 1, wherein a valve is provided in said casing to permit said circulation path.

3. A method according to claim 1, wherein said hole is drilled with a drilling assembly comprising a vertically extending rotatable member, means for drilling a hole fixed to the lower end of said member and a hole enlarging drilling unit located above said drilling means having a number of chisel blades circumferentially angularly offset and retractably mounted on said member, said drilling unit being provided with means for imparting a percussion drilling motion to said chisel blades.

4. A method according to claim 3, wherein said means for drilling a hole comprises a number of chisel blades vertically arranged with said member and provided with means for imparting a percussion drilling motion to said chisel blades.

5. A method according to claim 3, wherein said drilling assembly additionally comprises a drilling unit located above the means for drilling a hole, said unit having a number of chisel blades circumferentially arranged around said member and provided with means for imparting a percussion drilling motion to said chisel blades.

6. A method according to claim 5, wherein said chisel blades are angularly offset in relation to said member.

7. A method according to claim 3, wherein the means for imparting a percussion drilling motion to each chisel blade is provided by a drive plate in communication both with said rotatable member and a shaft of each chisel blade.

8. A method according to claim 3, wherein said drilling assembly further comprises a steering unit and a sensing unit.

9. A method according to claim 8, wherein said steering unit and sensing unit are positioned in close proximity to said means for drilling a hole.

* * * * *